US005181323A

United States Patent [19]

Cooper

[11] Patent Number: 5,181,323

[45] Date of Patent: Jan. 26, 1993

[54] HUNTING SCOPE FOR DETERMINING ACCURATE TRAJECTORY OF A WEAPON

[76] Inventor: Gary Cooper, Randolph County, Ark.

[21] Appl. No.: 770,106

[22] Filed: Oct. 31, 1991

Related U.S. Application Data

[62] Division of Ser. No. 650,210, Feb. 4, 1991, abandoned.

[51] Int. Cl.[5] ..... F41G 1/38

[52] U.S. Cl. ..... 33/245; 33/246; 359/422

[58] Field of Search ..... 33/245, 246, 297; 359/421, 422, 432; 42/101

[56] References Cited

U.S. PATENT DOCUMENTS

| | | | |
|---|---|---|---|
| 2,138,067 | 11/1938 | Mossberg | 33/246 |
| 2,997,916 | 8/1961 | Friedman et al. | 33/245 |
| 3,492,733 | 2/1970 | Leatherwood | 33/245 |
| 3,696,516 | 10/1972 | Thompson | 33/245 |
| 3,948,587 | 4/1976 | Rubbert | 33/245 |
| 4,297,789 | 11/1981 | Tominaga | 356/247 |
| 4,403,421 | 9/1983 | Shepherd | 33/246 |
| 4,789,231 | 12/1988 | Shimizu | 359/422 |
| 5,025,565 | 6/1991 | Stenerson et al. | 33/245 |

FOREIGN PATENT DOCUMENTS

| | | | |
|---|---|---|---|
| 2935462 | 3/1981 | Fed. Rep. of Germany | 33/245 |
| 0036823 | 3/1980 | Japan | 33/246 |
| 231657 | 7/1944 | Switzerland | 33/245 |

OTHER PUBLICATIONS

Instructions for Leupold Golden Ring Scopes, p. 7 (no dates).

*Primary Examiner*—William A. Cuchlinski, Jr.
*Assistant Examiner*—Alvin Wirthlin
*Attorney, Agent, or Firm*—Polster, Lieder, Woodruff & Lucchesi

[57] ABSTRACT

A variable power hunting scope has an objective, an eyepiece, and a barrel therebetween. The barrel carries a reticle, a zoom assembly, a vertical cross-hair, a horizontal cross-hair, vertical and horizontal posts, and an adjusting ring for altering the scope magnification. A locking mechanism interferes with rotation of the adjusting ring at a desired maximum magnification setting, the desired maximum magnification setting being between the minimum and maximum magnifications of the scope.

4 Claims, 2 Drawing Sheets

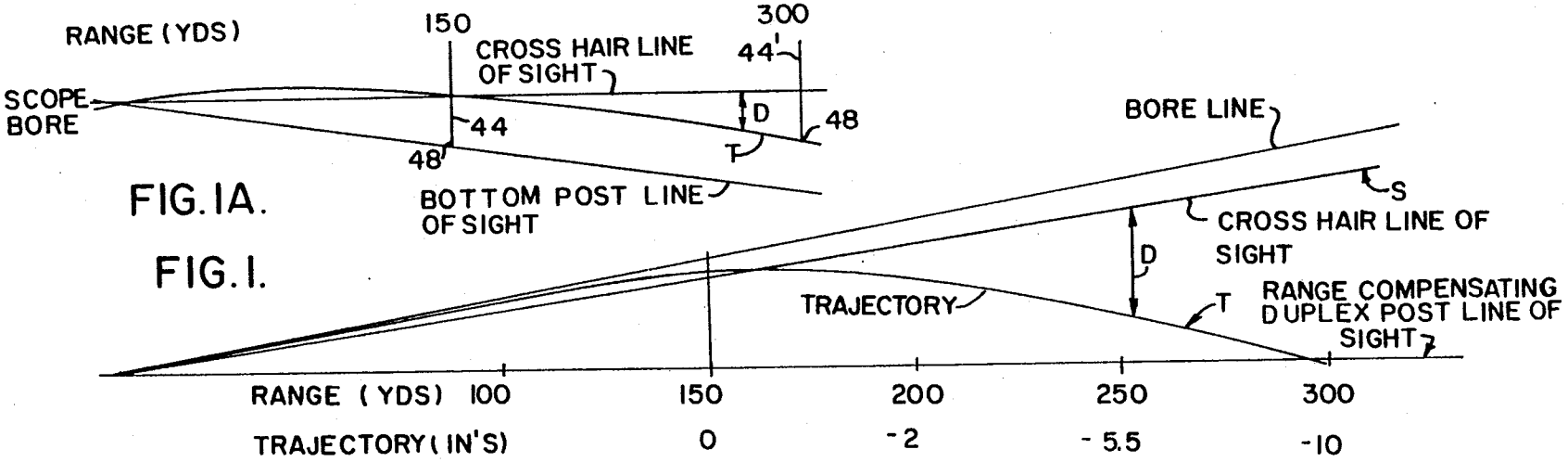
FIG. 1A.
FIG. 1.
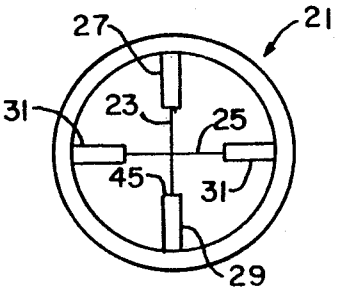
FIG. 3.
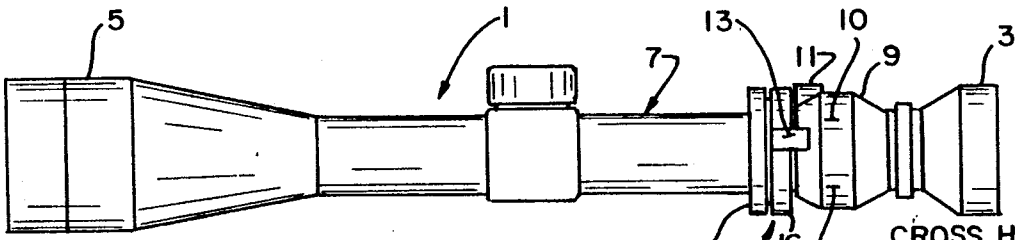
FIG. 2.
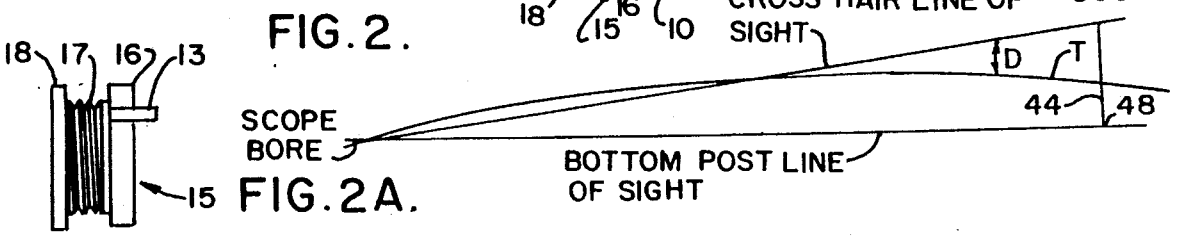
FIG. 2A.
FIG. 1B.

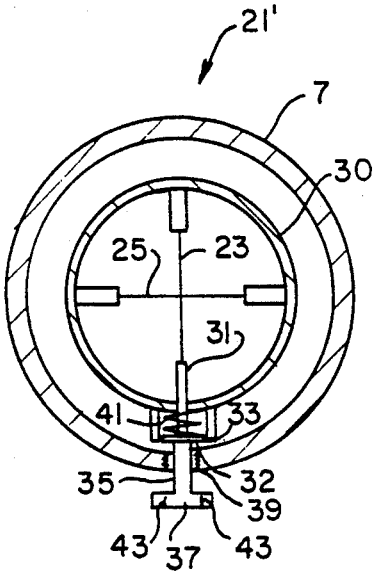
FIG. 4.
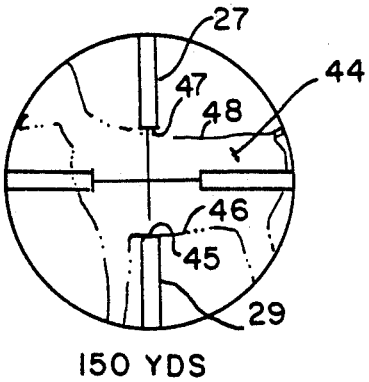
FIG. 5.
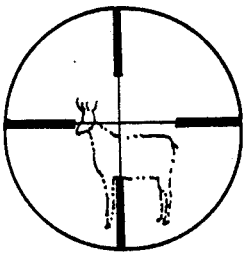
FIG. 6A.
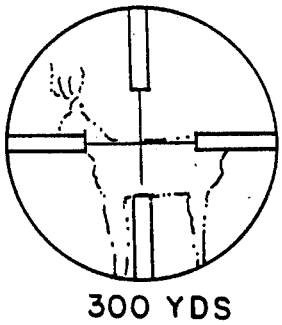
FIG. 6.
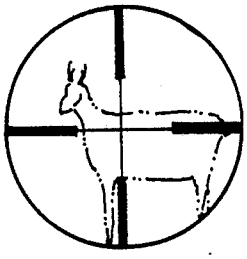
FIG. 6B.
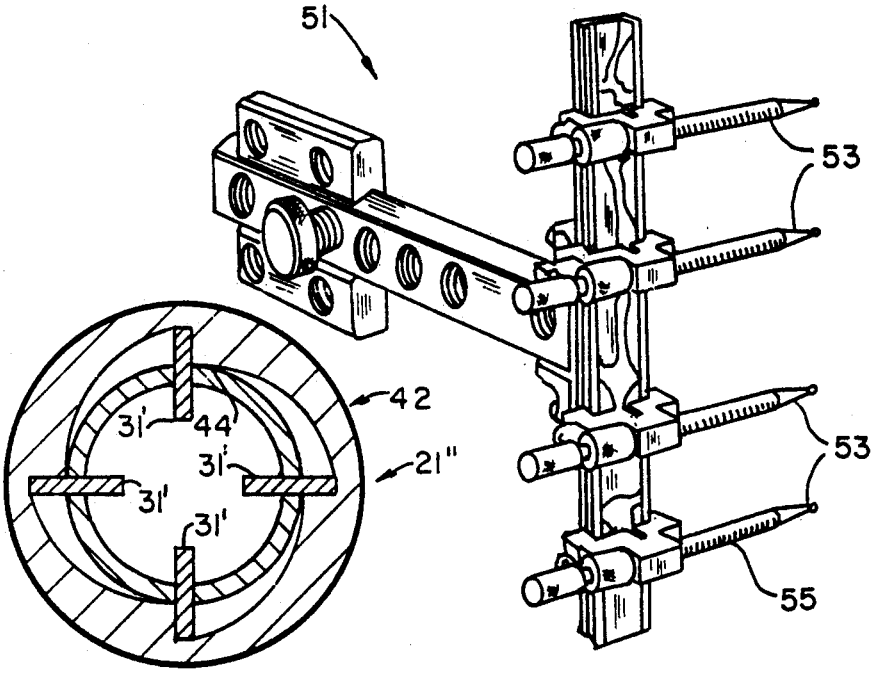
FIG. 4A.
FIG. 7.

HUNTING SCOPE FOR DETERMINING ACCURATE TRAJECTORY OF A WEAPON

This is a divisional of application Ser. No. 650,210, filed on Feb. 4, 1991, now abandoned.

BACKGROUND OF THE INVENTION

This invention relates to a method of compensating for the trajectory of a missile or projectile, such as a bullet or arrow, wherein the hunter need not continuously bracket the target nor know the range of the target to accurately determine the proper trajectory.

It is described in terms of a gun, but is applicable to a bow. Correction of trajectory relies on the principle that as the projector, such as a gun's barrel, is pivoted upward, a bullet shot from the gun will have a longer path. Prior art scopes which corrected for trajectory, pivoted the scope to determine how far to raise the gun barrel. Examples of such scopes are described in U.S. Pat. Nos. 3,492,733 to Leatherwood and 3,506,330 to Allen. With these scopes, a hunter must turn range finding knobs on the scope, bracketing the target between cross-hairs to accurately correct the bullet trajectory. If a target moves toward or away from the hunter, the target must be rebracketed at the new range. The operation of the range finder takes time, and, as there is little time in which to get a clean shot once a target is sighted, many hunters do not take the time to bracket their target properly. This results in a bullet's being shot with an improper trajectory which will miss the animal or only wound it.

Further, these scopes often have multiple horizontal cross-hairs or other aiming means. This clutters the field of view and makes quick short range shots more difficult as a hunter may forget with which cross-hair or other indicium to aim with.

Lastly, it is often difficult to keep a scope and rifle steady while turning the knobs of the scope.

One object of this invention is to provide a method for quickly and accurately determining a proper trajectory for a missile or projectile such as a bullet or the like.

Another object is to provide a method of trajectory correction which requires no rebracketing of a target for shots at different ranges.

Another object is to provide a method for quickly and accurately determining the approximate range of a shot, and to determine if it is within the range of the projectile and the hunter's ability to aim accurately.

Another object is to provide a reticle to facilitate the use of the method.

These and other objects will become apparent to those skilled in the art in light of the following disclosure and accompanying drawings.

SUMMARY OF THE INVENTION

In accordance with this invention, generally stated, a method for accurately determining the trajectory of a projectile is provided, which, when a gun scope is used, includes using a duplex type reticle. The duplex reticle includes a vertical and a horizontal cross-hair and top, bottom, and side posts at the ends of the cross-hairs. The method includes (1) determining a bracketing range for the ammunition used; (2) determining a trajectory compensating aim point on the target; (3) at the bracketing range, adjusting the duplex to bracket a target between the top and bottom posts with the cross-hairs centered on the target; and (4) maintaining the top of the bottom post on the bottom of the target at ranges beyond the bracketing range. The bottom post is used as a second reticle to compensate for the trajectory of the bullet reticle. When compensating for the trajectory of the projectile, the fourth step is the only step taken when game is sighted, the first three steps can be performed prior to the hunt. This method requires no adjustment of knobs to compensate for the trajectory.

The use of the bottom post as trajectory compensating reticle raises the barrel as the range to the target increases. This will approximate the compensation needed for the increasing gravitational drop of the projectile until the drop becomes extreme. The range at which the compensation ceases to accurately correct for the drop of the projectile is an extreme range beyond either the accuracy capability of the shooter, the kinetic energy of the projectile necessary for a clean kill, or both.

By noting the position of the top of the target in relation to the top post and the cross-hairs while the bottom post is on the bottom of the target, the range of the target can be quickly determined prior to shooting the gun. If the target is too far, the hunter can avoid taking a bad shot.

Reticles to facilitate use of the method are also disclosed.

A trajectory compensating method for use with bows is also disclosed.

BRIEF DESCRIPTION OF THE DRAWINGS

In the drawings, FIG. 1 is a graph showing the trajectory of a 130 grain bullet having a muzzle velocity of 2776 fps as compared with the bore line of a gun's barrel (bore line) and the line of sight from the cross-hair of the scope as the gun barrel and scope are angled upwardly to compensate for gravitational drop of the bullet.

FIGS. 1A and 1B are graphs showing the method of trajectory compensation of the invention.

FIG. 2 is a side elevational view of a variable power scope.

FIG. 2A is a side elevational view of a locking assembly of the scope of FIG. 2.

FIG. 3 is a plan view of a duplex type reticle.

FIG. 4 is a cross-sectional view of a duplex type reticle having an adjustable post, the reticle being within a scope.

FIG. **4*a*** is a cross-sectional view of another embodiment of a duplex type reticle having adjustable posts.

FIG. 5 shows an animal bracketed between the posts of the duplex reticle of FIG. 3.

FIG. 6 shows the top of the bottom post of the duplex reticle on the brisket of the hunted animal.

FIG. 6A shows a scope sighted on a target beyond the range of the target of FIG. 6.

FIG. 6B shows a scope sighted on a target at a distance between FIGS. 5 and 6.

FIG. 7 is a perspective view of a bow hunting sight assembly.

DESCRIPTION OF THE PREFERRED EMBODIMENT

The trajectory of a bullet is defined by parameters such as the shape, weight, and muzzle velocity of a bullet. The height of the sight (scope) above the bore must also be considered when using ballistics tables. When it is fired from a gun, the trajectory T of the bullet is not flat. As shown in FIG. 1, the bullet will pass above the line of sight, but will then begin to fall as it is pulled down by gravitational forces. There is thus a divergence D between trajectory T and line of sight S. The effect of divergence D is shown in the Table I below for a 0.308 caliber cartridge sighted in at 200 yards. Table II shows the effect of divergence D for the same cartridge, but sighted in at 150 yards.

TABLE I

| 200 Yard Zero - 150 Yard Bracket | | | |
|---|---|---|---|
| Range (yards) | Distance From Target Center With Cross-hairs Centered on Target (inches) | Distance Bore Raised Using The Method Of My Invention (inches) | Distance From Target Center Using The Method Of My Invention (inches) |
| 150 | +3 | — | +3 |
| 200 | — | +3 | +3 |
| 250 | −3 | +6 | +3 |
| 300 | −8 | +9 | +1 |
| 350 | −15 | +12 | −3 |

TABLE II

| 150 Yard Zero - 150 Yard Bracket | | | |
|---|---|---|---|
| Range (yards) | Distance From Target Center With Cross-hairs Centered on Target (inches) | Distance Bore Raised Using The Method Of My Invention (inches) | Distance From Target Center Using The Method Of My Invention (inches) |
| 150 | — | 0 | 0 |
| 200 | −2 | +3 | +1 |
| 250 | −5.5 | +6 | +0.5 |
| 300 | −10 | +9 | −1 |

A duplex type reticle 21 is shown in FIG. 3. Reticle 21 has a vertical cross-hair 23 and a horizontal cross-hair 25 which intersect in the center of reticle 21. A top post 27 and a bottom post 29 frame cross-hair 23. Cross-hair 25 is similarly framed by a pair of sideposts 31. I have found that by using the bottom post 29 as a second reticle and aiming it a determined point on a target, divergence D will be compensated for and the projectile will impact within a few inches of the "bullseye" The basic premise of the trajectory compensation method is shown in FIGS 1A and 1B. At 150 yds. (FIG 1A) the cross-hair line of sight is centered on a target 44, the bottom post line of sight is resting on the bottom 48 of the target, and the trajectory line T is centered on the target. As the distance of the target from the barrel increases, as at 300 yds., the distance from the bottom of the target 44' to the bottom post line of sight also increases. At this distance, if the cross-hairs are used as the aiming means, the bullet will impact far below the "bullseye" However, by constantly training the trajectory compensation duplex line of sight on the bottom of the target at increasing ranges, (FIG 1B) the cross-hair line of sight and the bore line are raised, properly compensating for the trajectory.

Trajectory compensation is needed at ranges past the "zero" range of the primary short range reticle 21 (i.e. the cross-hairs 23 and 25 of the reticle 21). Past the zero range, the projectile drops below the desired impact point resulting in a miss. The "zero" range is the range at which the projectile will hit the center of a target when aiming with the cross-hairs. For most hunting bullets, the zero range is approximately 150 yds.

To compensate for the trajectory past the zero range, the hunter aims with the top 45 of the bottom post 29, using the bottom post as a secondary reticle The bottom post is positioned on the target so that the line of sight will fall on a point below the desired impact of the projectile This is a trajectory compensation aim point The trajectory compensation aim point most often used on big game is the brisket (the bottom 48 of the target).

When using the method, a hunter first selects a "zero" range for the short range reticle (cross-hairs). An advantage of using a short-range zero is that it results in a flatter trajectory. As seen in the tables above, the use of a longer zero range results in a greater shooting range, but also in less accuracy.

The hunter then determines the range (with the cross-hairs centered on the target) at which the projectile impacts the chosen trajectory compensation aim point This is the impact range of the trajectory compensation aim point. It may be found through experience or by using ballistics tables.

The bracketing range (trajectory compensation reticle set range) is then determined by dividing the impact range by two. At this range, the trajectory compensation reticle 29 should be adjusted so that, with the cross-hairs centered on the target, the upper post 27 and lower post 29 bracket the target (with big game, the shoulder and brisket of the animal) as shown in FIG. 5. The zero range and bracketing range are often the same for deer.

As can be seen from Tables I and II, if the trajectory compensation method is relied upon, the bullet will impact its target within ±3 inches.

This method also allows a hunter to approximately determine the range of the shot. Due to perspective, as the target is viewed at greater distances, the apparent size of the target will decrease. If a scope is set so that at a certain range the target will appear bracketed when the bottom post tip is placed on the animal's brisket (the trajectory compensation aim point), the crosshairs will be on the middle of the target. (FIG. 5) If the range to the target is greater than the set range, when the bottom post top is placed on the brisket, the target will no longer bracket and the crosshairs will appear to be progressively higher on the target as the range increases. This is seen in FIGS. 6B, 6, and 6A. For instance, when the crosshair is on the animal's shoulder (FIG. 6), the animal is at twice the bracketing range, or 300 yds. This allows a hunter to quickly determine if the target is beyond the range of the bullet or beyond the range of his ability, and, whether it is wise for him to take the shot.

Only two ranges are important to note and are quickly determined: (1) the approximate minimum range at which to begin trajectory compensation; and (2) the approximate range at which trajectory compensation is effective. If the target does not fit between the top post 27 and bottom post 29, the target is at a range less than the "zero" range and the primary short range aim point (i.e. the cross-hairs) should be used. If the target does not bracket between the trajectory compensation bottom post 29 and the horizontal cross-hair 25 (FIG. 6A) the range is beyond basic capabilities of the method. FIG. 6B shows the target somewhere between 150 and 300 yds, a range between the two distances just noted.

Turning to FIG. 2, there is shown a variable power hunting scope 1 which may be mounted on a gun (not shown) in the standard way well known in the art to be used with the above method. Scope 1 includes an eyepiece 3, an objective 5 and a barrel 7 containing erecting and magnifying lenses assembled in a zoom system. The zoom system is controlled by an adjusting ring 9. Ring 9 may include indicators 10 at specific magnifications at specific distances. Indicators 10 mark the magnification at which different species, deer and elk for instance, would be bracketed.

Ring 9 has a neck 11 which cooperates with a finger 13 of a lock assembly 15 to enable a hunter to limit the highest magnification to which ring 9 may be turned. (FIG. 2A) Lock assembly 15 includes a first annular member 16 which rotates freely about an externally threaded body 17 securely fixed to barrel 7 adjacent ring 9. Finger 13 is secured to member 16 perpendicular to the plane of member 16 so that it may interfere with the rotation of neck 11. A lock-nut 18 is secured against member 16 to lock member 16 in place. Lock assembly 15 limits the maximum power to which the scope can be set. This new maximum power becomes the power at which a hunter compensates for the bullet's trajectory.

Barrel 7 carries reticle 21 mounted in an erector tube lens 30. Reticle 21 is generally positioned behind the zoom system at the rear focal point in variable power scopes. Reticle 21 may alternately be placed in front of the zoom system at the front focus point. Placing reticle 21 in front of the zoom system allows the posts to bracket a target 48 at any range. With the posts at the front focal point, the posts will appear to withdraw from each other as magnification increases and, therefore, appear to come together as magnification decreases. If, then, the posts are sized to optically bracket the target at one power, as the power is increased the apparent size of the target will increase, the posts will appear to withdraw from the field of view, and the target will remain bracketed. Thus, the scope will work continuously at all powers.

Instead of being a one piece reticle, reticle 21 may comprise a first part with the horizontal and vertical cross-hairs 25 and 23 and a second part with the top and bottom posts 27 and 29. In the two piece reticle system, the first piece may be placed at the rear focal point and the second piece may be placed at the front focal point of the scope. In this arrangement, the scope will still work at all powers, but the crosshairs will remain the same apparent thickness at any power. This is preferred by some sportsmen.

In another embodiment, a reticle 21' may include adjustable posts so that the distance between the posts may be altered (FIG. 4). Only one adjustable post is shown in FIG. 4 for clarity. However, any one or all four posts may be made adjustable. It is contemplated, though, that the posts will be made adjustable in pairs, there being a top-bottom post pair and/or a side-side post pair. This will allow the the center of the scope to always be equidistant from opposite posts.

In this embodiment an adjustable post 31 having a collar flange 32 is slidably mounted in a channel 33 between scope barrel 7 and erector lens tube 30. Post 31 extends from channel 33, through a bore in erector lens tube 30 and into reticle 21. A screw 35 having a knob 37 is threaded through a threaded bore 39 in barrel 7 to be in contact with post collar 32. A spring 41 biases post 31 against screw 35. Thus, the post may be moved inward and outward by adjusting screw 35. Post 31 and screw 35 may be made from a single piece, eliminating the need for spring 41 and collar 32. As above, reticle 21' may be split so that the vertical and horizontal cross-hairs are placed at different focal points.

In yet another embodiment (FIG. 4A), a reticle 21'' includes a collar 42 which is inserted in scope 1. Collar 42 has an interior cam surface 44 which replaces the screw 35 of FIG. 4 and allows for simultaneous movement of all four posts. Cam surface 44 includes four identical arcuate surfaces which cause movable posts, such as post 31', to move inwardly and outwardly as collar 42 is rotated. Cams surfaces 44 may be grooved to receive posts 31, in order to cause the post 31' to move inwardly and outwardly as collar 42 is rotated. Alternatively, post 31' can be spring biased to urge post 31' against cam surface 44 so that it will move outwardly as collar 42 is rotated.

The use of a reticle having adjustable posts would eliminate the need for having multiple reticles for a fixed power scope. By adjusting posts 31 and 31', various size animals may be bracketed between the posts at the same distance by adjusting the posts. Knob 37 and collar 42 may be supplied with species indicators 43, similar to indicators 10 on adjusting ring 9, to indicate settings which will bracket various animals at a fixed distance. The reticles of FIGS. 4 and 4A may also be used advantageously with the two-piece reticle system disclosed above.

The adjustable reticle can also replace the need for multiple ballistic-specific reticles in a fixed power scope. Indicators 43 can be set for varying ballistics while indicators 10 can be used to bracket targets.

Bracketing may be accomplished by rotating power knob 9 in a variable power scope or by adjusting posts 31 in either a variable or fixed power scope or in a scope using a reticle such as reticle 21' or 21''. By increasing or decreasing the power, the target will appear to grow larger or smaller and will thus appropriately fill the space between posts 27 and 29. Once bracketed, the scope is limited to that maximum power with locking assembly 15 This will keep the hunter from aocidentally increasing the power of the scope too much and throwing off the compensation settings trajectory.

It is important to realize that this method works with or without magnification. It works as long as the apparent size of the duplex is matched to the apparent size of the target at the bracketing range. When viewing through a scope, the bottom post must be arranged where the line of sight from the top of the bottom post remains proportionally constant in respect to the size of target. As long as the line of sight is determined and adhered to throughout operation, it makes no difference whether the target image is magnified or not. Advantage, however, can be taken of the magnification to make a scope adjustable in respect to the projectile trajectory and the chosen target size. If the bottom post is in the rear focal plane, it remains the same optical size, because it is not magnified as the power of the scope is increased. Instead of changing the physical length of the posts, as in reticles 21' or 21'', to achieve bracketing at the bracketing range, it is possible to magnify the target until it brackets. Thus, when the target is moved further away, the divergence of the line of sight of the bottom post and the bore line increases. While no adjustments are made during trajectory compensation (raising the gun's bore), the scope must be set at the determined bracketing range power for the trajectory compensation to be effective. If the posts are placed in the front focal plane, the physical length of the posts must be matched to the trajectory-target size, as the scope now brackets at the bracketing range at any power.

The trajectory compensation method also works well with cartridges of limited kinetic energy. With these bullets, however, the power of the scope is set in the middle of its power range, rather than at full power. For example, with a 4–12x variable scope, a 30—30 cartridge with a 225 yard range would be set at 8x, whereas a 0.270 cartridge with a 350 yard range would be set at 12x. If a 3–9x variable scope were used, the power settings would be at 6x and 9x, respectively.

A fixed power range finder may also be used by using interchangeable reticles, wherein the reticles have varying sized posts so that the target may be bracketed. Use of reticle 21' or 21'', as noted above, eliminates the need for multiple reticles in a fixed power scope.

Although the method has been described for use with a rifle, it may also be used with a bow. When used with a bow, a bow hunting sight assembly 51 having pins 53 (FIG. 7) is mounted on a bow (not shown) in the usual manner. Pins are set for approximately 15, 25, and 35 yards, depending on the weight and speed of the arrow used. With the 25 yard pin centered on the target, a fourth pin designated the trajectory compensating pin 55 is set to aim approximately 25" low on the target. This corresponds approximately to a 45 yard pin when used with a 200 fps bow in a normal manner.

To quickly compensate for trajectory, pin 55 is aimed at the dewclaw (approximately 4" above the ground) for a deer, when the animal is 15–35 yards away. For an elk, the pin 55 would be aimed at the knee. By aiming pin 55 in this manner, the trajectory of the arrow is compensated for in the range of 15–35 yards and will hit the target in a vital area without the hunter's needing to know the actual range. However, if the animal is within 15 yards, using pin 55 will result in missing the target. Thus, before shooting, the hunter should glance up to make sure the 15 yard pin is not below the center of the target. If it is, the bow can be sighted in the normal manner using the 15 yard pin. If the 35 yard pin is above the middle of the target, the target is out of range (beyond 35 yards). Thus the hunter should also check the 35 yard pin before shooting.

Pin 55 "programs" the arrow to hit 25" above the target (the dewclaw). Thus, considering the average deer is 38" high at the shoulder and has a body width of 18", the brisket is approximately 20" above the ground. Thus, by aiming at the dewclaw, 4" above the ground, the arrow will impact 29" above the ground or in the middle of the body.

If there is no visual contact with the legs, then aiming pin 55 below a deer's brisket a distance equal the width of the deer's body will yield good results, the width being the distance from the animals brisket to its back. Considering a deer stands 38" at its shoulder, this formula would place pin 55 2" above the ground. For an elk, pin 55 would be aimed below the elk's brisket a distance equal to approximately one-half the body width (14"). An anchor point below the eye should be used with this method, such as the corner of the mouth, jaw, or chin.

Numerous variations, within the scope of the claims, will be apparent to those skilled in the art in light of the foregoing description and accompanying drawings.

Having thus described the invention, what is claimed and desired to be secured by Letters Patent is:

1. A variable power hunting scope having an objective and an eyepiece, a barrel intermediate said eyepiece and objective, said barrel carrying a reticle, a zoom assembly, a vertical cross-hair, a horizontal cross-hair, vertical and horizontal posts, and an adjusting ring for altering the magnification of said scope, wherein said scope includes locking means for interferring with rotation of said adjusting ring of a desired maximum magnification setting, said desired maximum magnification setting being less than the maximum magnification of said scope and greater than the minimum magnification of said scope.

2. The scope of claim 1, wherein said adjusting ring includes species indicating marks, said marks indicating the magnification at which varying sized targets may be bracketed between said posts at a single range.

3. The scope of claim 1, wherein said cross-hairs are separated from said posts, said cross-hairs being mounted in one of a rear focal plane or a front focal plane of said scope and said posts being mounted in the other of said front focal plane or rear focal plane of said scope.

4. A variable power hunting scope having an objective and an eyepiece, a barrel intermediate said eyepiece and objective, said barrel carrying a reticle, a zoom assembly, a vertical cross-hair, a horizontal cross-hair, vertical and horizontal posts, and an adjusting ring for altering the magnification of said scope, wherein said scope includes locking means for preventing said adjusting ring from rotating past a desire maximum magnification setting; said locking means comprising an annular ring which rotates freely on an externally threaded body fixedly secured to said barrel adjacent said adjusting ring and an internally threaded lock-nut which screws against said annular ring on said body to rotationally secure said ring in place, said annular ring having a finger thereon which interferes with the rotation of said adjusting ring when said ring is rotationally secured in place by said lock-nut, thereby limiting the maximum power to which said scope may be set.

* * * * *